US010449787B2

(12) United States Patent
Watanabe

(10) Patent No.: US 10,449,787 B2
(45) Date of Patent: Oct. 22, 2019

(54) MEDIUM SUPPORT UNIT, PRINTING APPARATUS, HEATING APPARATUS, AND PRINTING METHOD

(71) Applicant: SEIKO EPSON CORPORATION, Tokyo (JP)

(72) Inventor: Yusuke Watanabe, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 26 days.

(21) Appl. No.: 15/686,406

(22) Filed: Aug. 25, 2017

(65) Prior Publication Data

US 2018/0056675 A1 Mar. 1, 2018

(30) Foreign Application Priority Data

Sep. 1, 2016 (JP) ..... 2016-171037

(51) Int. Cl.

| | |
|---|---|
| ***B41J 11/58*** | (2006.01) |
| ***B41J 3/407*** | (2006.01) |
| ***B41J 11/00*** | (2006.01) |
| ***B41J 3/60*** | (2006.01) |
| ***B41J 11/06*** | (2006.01) |
| *B41J 13/00* | (2006.01) |

(52) U.S. Cl.

CPC ..... *B41J 11/58* (2013.01); *B41J 3/4078* (2013.01); *B41J 3/60* (2013.01); *B41J 11/002* (2013.01); *B41J 11/0015* (2013.01); *B41J 11/06* (2013.01); *B41J 13/00* (2013.01)

(58) Field of Classification Search

CPC ... B41J 3/4078; B41J 3/60; B41J 11/58; B41J 11/0015; B41J 11/002; B41J 11/06

See application file for complete search history.

(56) References Cited

U.S. PATENT DOCUMENTS 6,908,190 B2 6/2005 Iwatsuki et al.
7,311,041 B2 * 12/2007 Niimi ..... B41F 15/02 101/114

FOREIGN PATENT DOCUMENTS

| | | |
|---|---|---|
| JP | 2004-262214 | 9/2004 |
| JP | 2005-068595 | 3/2005 |
| JP | 3969168 | 6/2007 |

* cited by examiner

*Primary Examiner* — Thinh H Nguyen
(74) *Attorney, Agent, or Firm* — Workman Nydegger

(57) ABSTRACT

A medium support unit that supports a medium to be printed on by a printing apparatus includes a support section and a frame section. The support section has a first support face and a second support face that are capable of supporting the medium. The frame section retains the support section. The frame section includes a first placement portion that is placed on a base of the printing apparatus when the first support face is set as a printing face on which the medium is printed, and a second placement portion that is placed on the base when the second support face is set as the printing face.

14 Claims, 14 Drawing Sheets

MEDIUM SUPPORT UNIT, PRINTING APPARATUS, HEATING APPARATUS, AND PRINTING METHOD

BACKGROUND

1. Technical Field

The present invention relates to a medium support unit, a printing apparatus, a heating apparatus, and a printing method.

2. Related Art

Hitherto, medium support units in which a medium is supported on a support section have been employed in printing apparatuses. Such a medium support unit is sometimes employed to print at different positions on the medium. Generally, in such cases, a medium that has been set on the medium support unit and printed on is temporarily removed and the orientation or the like of the medium is changed, and then the medium is again set on the medium support unit and printed on once more. However, this takes time and effort.

JP-A-2004-262214 describes a printing apparatus (an ink jet printer) for reducing such time and effort. This printing apparatus has a configuration in which a medium support unit is retained on a rotation shaft. The medium support unit has two medium-supporting faces. It is possible to switch between the medium-supporting faces by rotating the medium support unit about the rotation shaft.

However, since the printing apparatus described in JP-A-2004-262214 has a configuration in which the entire medium support unit is retained on a single rod-shaped rotation shaft, it is difficult to stabilize the medium support unit, and the medium is not able to be stably supported on the support section.

SUMMARY

An advantage of some aspects of the invention is that a medium-supporting face can be easily changed and printed on while a medium is stably supported on a support section.

A medium support unit of a first aspect of the invention is a medium support unit that supports a medium to be printed on by a printing apparatus. The medium support unit includes a support section and a frame section. The support section has a first support face and a second support face that are capable of supporting the medium. The frame section retains the support section. The frame section includes a first placement portion that is placed on a base of the printing apparatus when the first support face is set as a printing face on which the medium is printed, and a second placement portion that is placed on the base when the second support face is set as the printing face.

This aspect includes the support section and the frame section. The support section has the first support face and the second support face. The frame section includes the first placement portion that is placed on the base when the first support face is set as the printing face, and the second placement portion that is placed on the base when the second support face is set as the printing face. Accordingly, a medium-supporting face can be easily switched and printed on by printing using the first support face as the printing face and then printing using the second support face as the printing face. Placing the first placement portion on the base when the first support face side is to be printed on and placing the second placement portion on the base when the second support face side is to be printed on enables the support section to be stably supported on the base and enables a medium to be stably supported on the support section. Thus, a medium-supporting face is able to be easily changed and printed on while a medium is stably supported on the support section.

The frame section of the medium support unit may be inserted between the first support face and the second support face to retain the support section.

According to this aspect, the frame section may be inserted between the first support face and the second support face to retain the support section. This enables the frame section to be easily configured not to protrude from the printing face. Accordingly, obstruction of printing due to the frame section protruding from the printing face can be easily suppressed.

The frame section of the medium support unit may pinch the support section from the first support face-side and the second support face-side to retain the support section.

According to this aspect, the frame section may pinch the support section from the first support face-side and the second support face-side to retain the support section. The support section can thereby be suitably retained by the frame section.

An inclined portion may be provided at an outer peripheral portion of at least one of the first support face or the second support face. The inclined portion may be inclined such that in a state in which the frame section is placed on the base, the medium supported on the printing face approaches closer to the base with greater proximity to the outer edge of the outer peripheral portion.

According to this aspect, the inclined portion may be provided. The inclined portion may be inclined such that in a state in which the frame section is placed on the base, positions where the medium is supported at the printing face are closer to the base with greater proximity to the outer edge of the outer peripheral portion. Although the outer peripheral portion of the first support face and the second support face are liable to leave a mark on portions of a medium supported thereby, adopting such a configuration enables marking of the medium to be suppressed.

The frame section of the medium support unit may be provided with a mark to indicate the orientation of the medium support unit when the medium support unit is placed on the base.

According to this aspect, the frame section may be provided with a mark to indicate the orientation of the medium support unit when the medium support unit is placed on the base. Accordingly, placement of the frame section on the base in an incorrect orientation can be suppressed when the frame section is placed on the base.

A printing apparatus according to a second aspect of the invention includes the medium support unit of the aspect described above, the base, and a printing section. The printing section prints on the medium supported by the support section of the medium support unit that is on the base.

This aspect includes the medium support unit configured as described above. Accordingly, a medium-supporting face can be easily switched and a medium printed on while the medium is stably supported on the support section.

In a state in which the frame section is on the base, an open space may be provided between the support section and the base.

According to this aspect, in a state in which the frame section is on the base, the open space may be provided between the support section and the base. Accordingly, in cases in which the second support face is set as the printing face and printed on after the first support face has been set as the printing face and printed on, it is possible to suppress reduction in image quality due to a previously printed portion printed on the first support face side making contact with the base while the second support face side is being printed on.

A heating apparatus according to a third aspect of the invention includes a mounting portion and a heating section. The mounting portion is mountable with the medium support unit of the aspect described above. The heating section is capable of heating both the first support face and the second support face of the support section of the medium support unit mounted to the mounting portion.

This aspect enables heat to be easily applied at once to both the first support face and the second support face so as to fix printed images on a printed article without removing the printed article from the medium support unit, of which a medium-supporting face has been easily switched to print the printed article while the medium was stably supported on the support section.

A printing method of a fourth aspect of the invention is a printing method employing a medium support unit including a support section and a frame section. The support section has a first support face and a second support face that are capable of supporting a medium to be printed on by a printing apparatus. The frame section is capable of retaining the support section. The frame section includes a first placement portion that is placed on a base of the printing apparatus when the first support face is set as a printing face on which the medium is printed, and a second placement portion that is placed on the base when the second support face is set as the printing face. The printing method includes placing the first placement portion on the base and printing on the medium on the first support face, and placing the second placement portion on the base and printing on the medium on the second support face.

According to this aspect, the first placement portion is placed on the base and the first support face side is printed on as the printing face, and the second placement portion is placed on the base and the second support face side is printed on as the printing face. Thus, a medium-supporting face is able to be easily changed and printed on while a medium is stably supported on the support section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed explanation follows regarding a printing apparatus 1 according to an embodiment of a liquid ejecting apparatus of the invention, with reference to the accompanying drawings.

Figure 1:
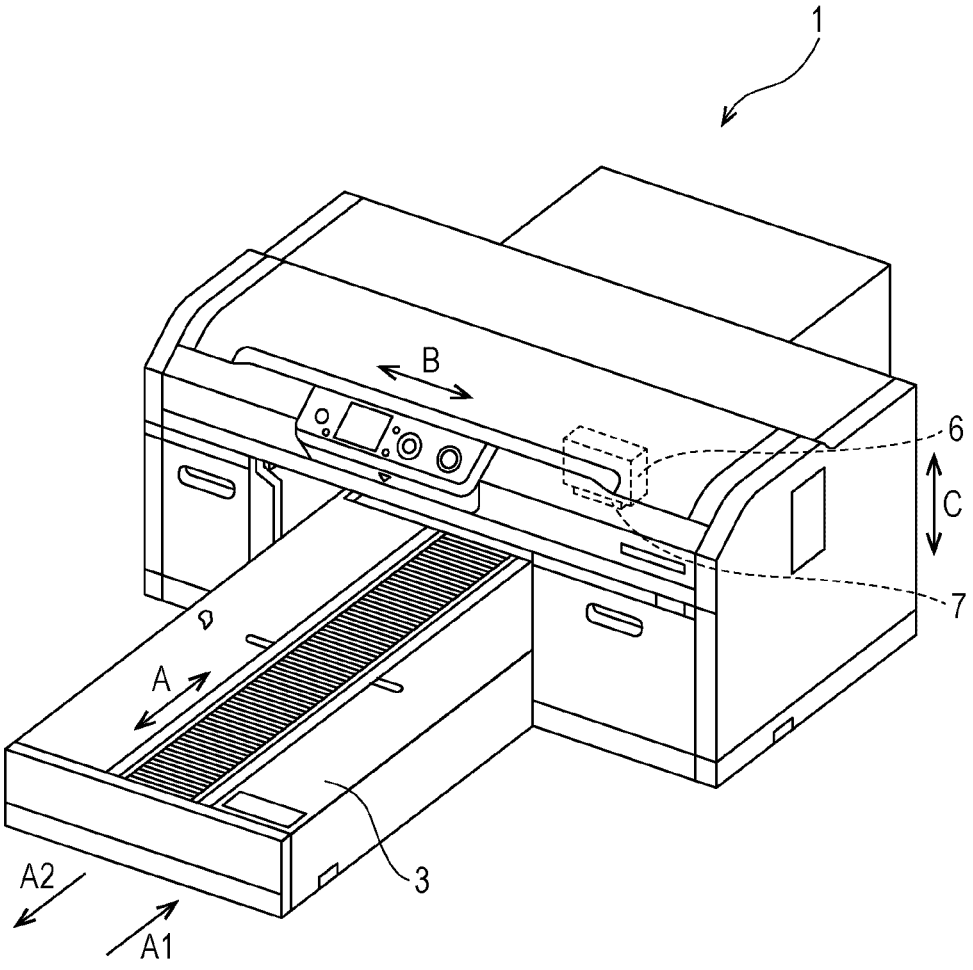
FIG. 1 is a schematic perspective view illustrating a printing apparatus according to an embodiment of the invention.
Figure 2:
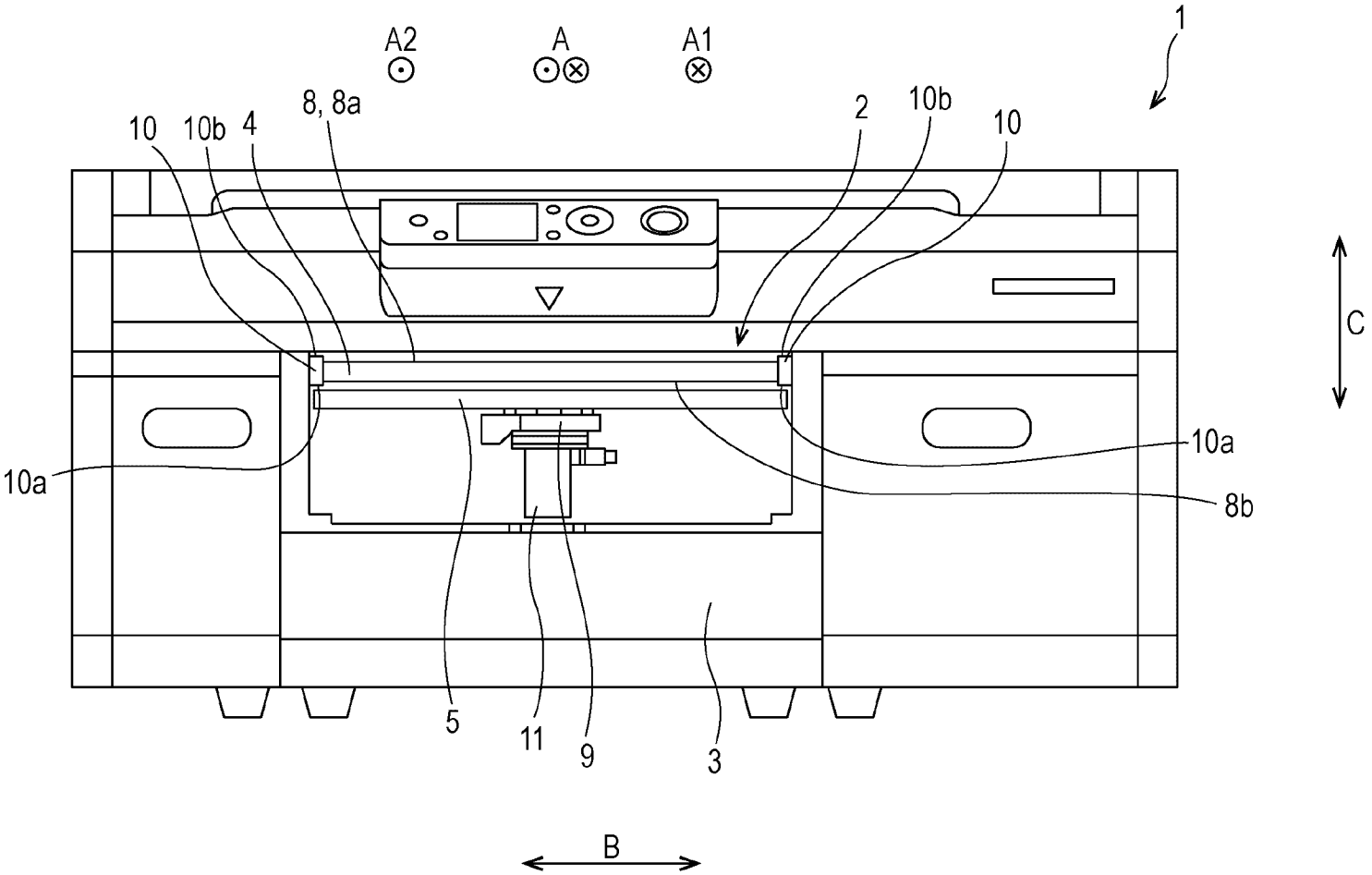
FIG. 2 is a schematic front view illustrating the printing apparatus according to the embodiment of the invention.
Figure 3:
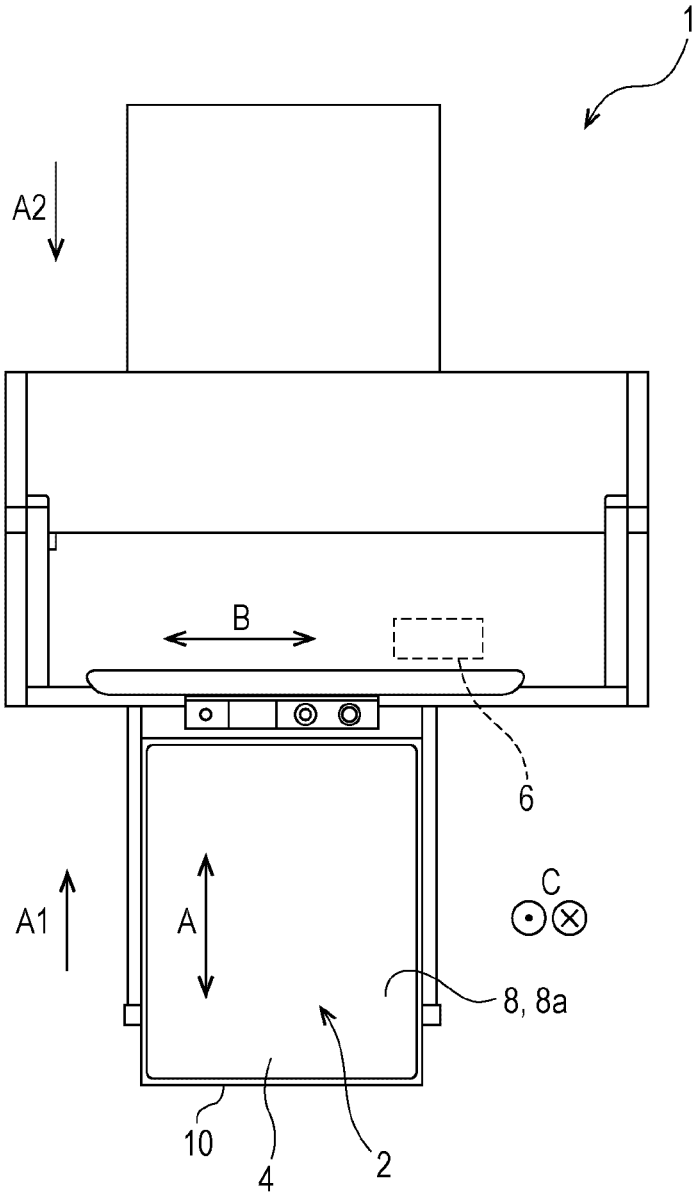
FIG. 3 is a schematic plan view illustrating the printing apparatus according to the embodiment of the invention.

FIG. 1 is a schematic perspective view of a printing apparatus 1 according to the present embodiment, and illustrates a state in which a medium support unit 2 is in a printing start position. FIG. 2 is a schematic front view of the printing apparatus 1 of the present embodiment. FIG. 3 is a schematic plan view of the printing apparatus 1 of the present embodiment, and illustrates a state in which the medium support unit 2 is in a medium set position. Note that some configuration members are simplified in FIG. 1 to FIG. 3.

The printing apparatus 1 of the present embodiment includes the medium support unit 2, which is moved along a movement direction A in a state in which a medium is supported by support faces (first support face 8*a* and second support face 8*b*, described below) of a tray 4, which serves as a medium support section. Note that the medium support unit 2, this being a relevant portion of the printing apparatus 1 of the present embodiment, is configured by the tray 4 and a frame section 10. The configuration of the medium support unit is described in detail below.

The printing apparatus 1 also includes a medium transport portion 3 that transports a medium supported by the tray 4 along the movement direction A. The movement direction A is a direction encompassing a direction A1 and a direction A2. The direction A2 is the opposite direction to the direction A1.

The medium support unit 2 is detachably mounted to a base 5 of the printing apparatus 1. An attachment/detachment direction C of the medium support unit 2 with respect to the base 5 is the vertical direction in the case of the printing apparatus 1 of the present embodiment. Rotating a lever 9 moves the medium support unit 2 and the base 5 in a direction (the vertical direction) following the attachment/detachment direction C. Note that as illustrated in FIG. 2, the lever 9 is provided to an arm portion 11. In addition, various materials such as textiles (fabric, cloth, etc.), paper, and vinyl chloride resin can be employed as the medium.

A print head 7 is provided inside the body of the printing apparatus 1. The print head 7 serves as a printing section capable of ejecting ink or other liquid, from a nozzle so as to print on the medium. The printing apparatus 1 of the present embodiment, a carriage 6 retaining the print head 7 is recprically moved in a scanning direction B, which intersects the movement direction A and, while the print head 7 is reciprically moved in the scanning direction B, ink is ejected from the print head 7 onto a medium supported by the tray 4 to form a desired image.

Note that in the printing apparatus 1 of the present embodiment, the near side (lower left direction) in FIG. 1 is the position of the tray 4 for setting a medium in the tray 4 (see FIG. 3). The tray 4 on which the medium has been set is then moved in the direction A1 of the movement direction A to a printing start position at the far side (upper right direction) of FIG. 1. Then, printing is performed while the tray 4 is moved along the direction A2 of the movement direction A.

Explanation follows regarding the electrical configuration in the printing apparatus 1 of the present embodiment.

Figure 4:
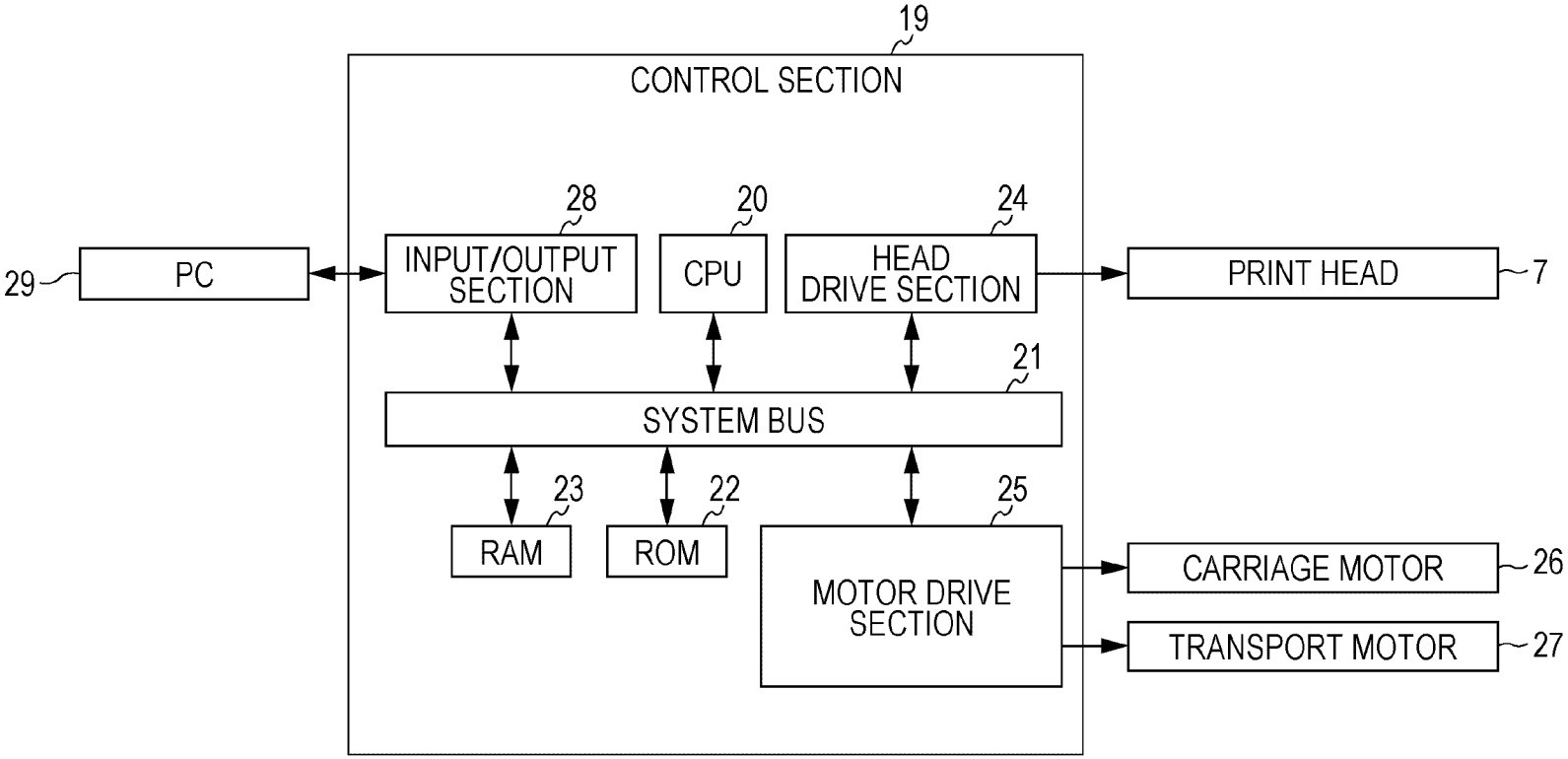
FIG. 4 is a block diagram of the printing apparatus according to the embodiment of the invention.

FIG. 4 is a block diagram of the printing apparatus 1 of the present embodiment.

A control section 19 is provided with a CPU 20 that governs the overall control of the printing apparatus 1. The CPU 20 is connected, through a system bus 21, to ROM 22 which stores various control programs and the like executed by the CPU 20, and to RAM 23 which is capable of temporarily storing data.

The CPU 20 is also connected to a head drive section 24 for driving the print head 7 through the system bus 21.

The CPU 20 is also connected to a motor drive section 25 through the system bus 21. The motor drive section 25 is connected to a carriage motor 26 for moving the carriage 6 provided with the print head 7, and to a transport motor 27 provided to the medium transport portion 3 for transporting medium (namely, moving the medium support unit 2).

In addition, the CPU 20 is connected to an input/output section 28 through the system bus 21. The input/output section 28 is connected to a PC 29 for exchanging signals and data such as print data.

The control section 19 performs overall control of the printing apparatus 1 through such configuration.

Explanation follows regarding the medium support unit 2, which is a relevant portion of the printing apparatus 1 of the present embodiment.

Figure 5A:
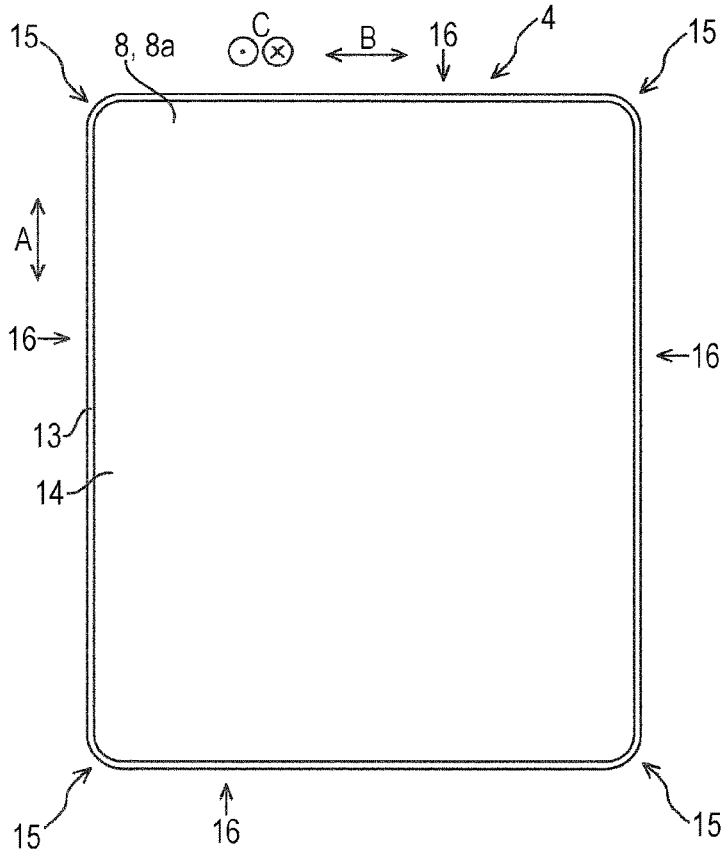
FIG. 5A is a schematic plan view illustrating a tray of a medium support unit of a first embodiment.
Figure 5C:
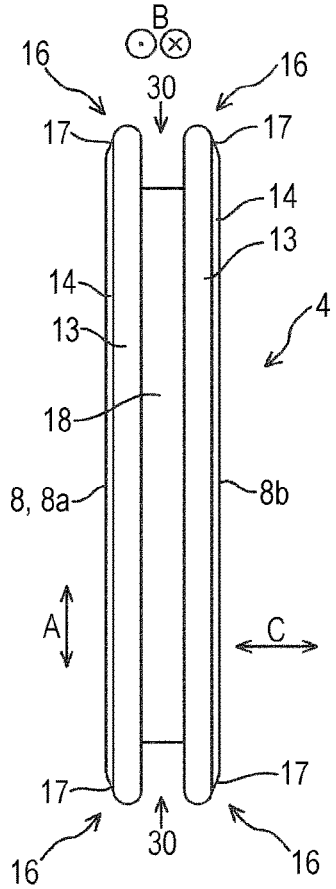
FIG. 5C is a schematic side view illustrating the tray of the medium support unit of the first embodiment.
Figure 5B:
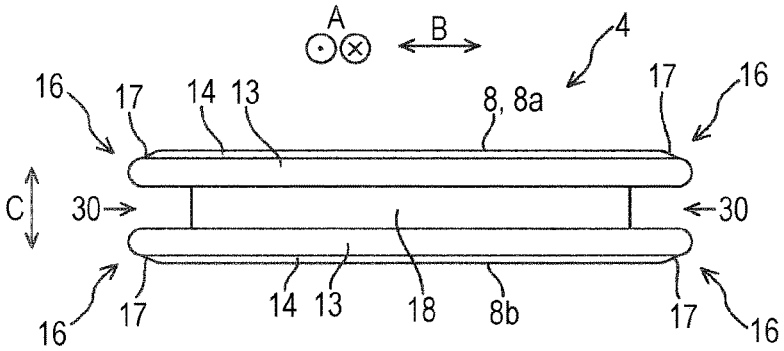
FIG. 5B is a schematic front view illustrating a tray of a medium support unit of the first embodiment.

FIG. 5A is a schematic plan view illustrating the tray 4 of the medium support unit 2 of the first embodiment, FIG. 5B is a schematic front view illustrating the tray 4 of the medium support unit 2 of the printing first embodiment, and FIG. 5C is a schematic side view illustrating the tray 4 of the medium support unit 2 of the first embodiment.

Figure 6A:
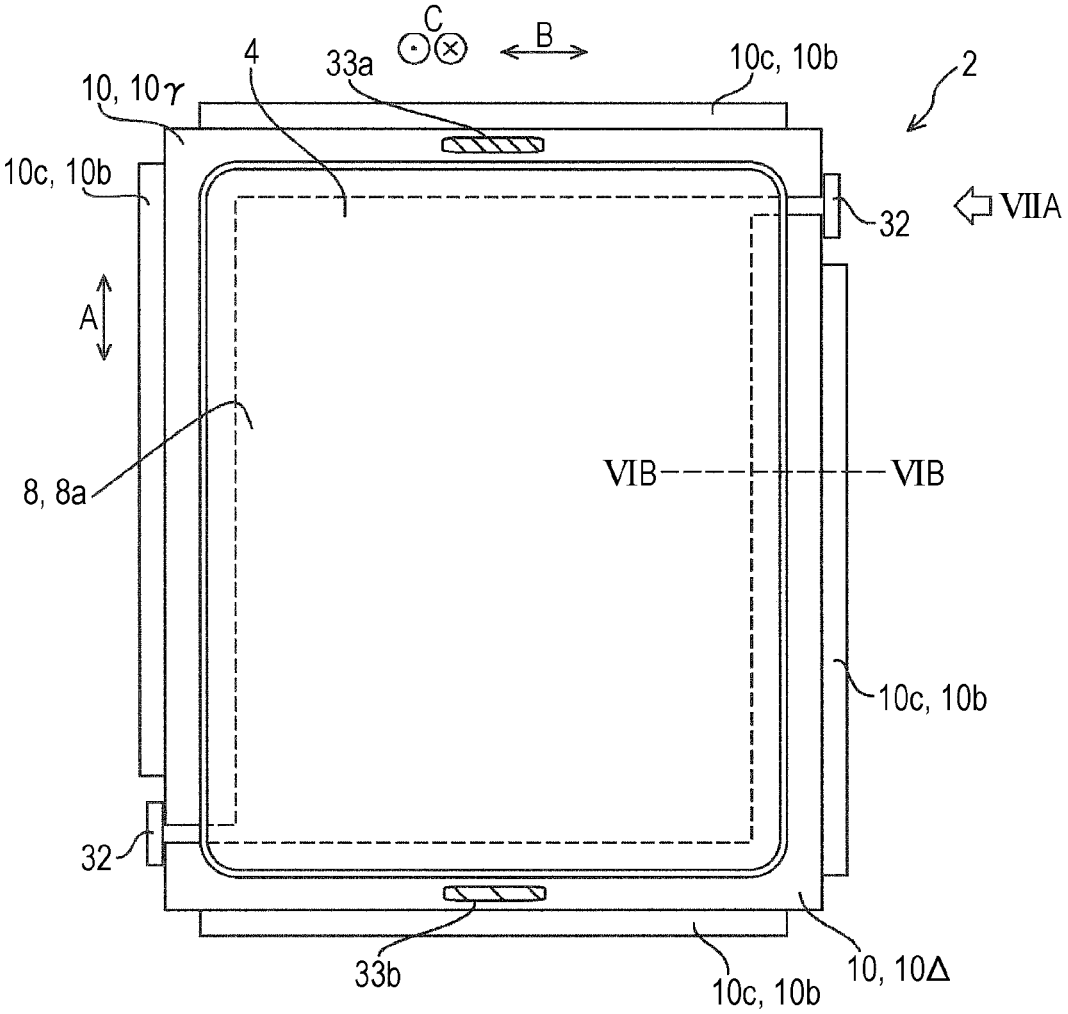
FIG. 6A is a schematic plan view illustrating the medium support unit of the first embodiment.
Figure 6B:
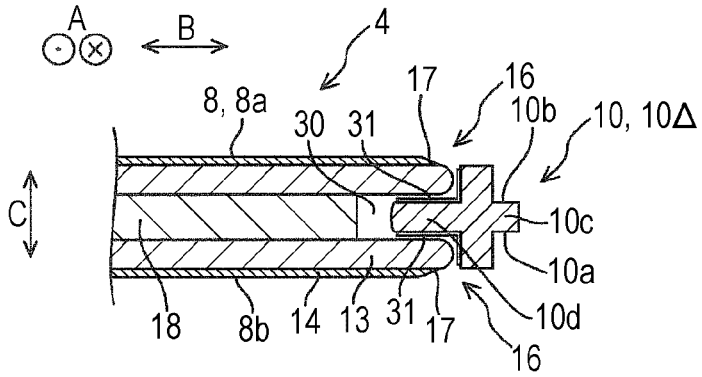
FIG. 6B is a schematic cross-section as viewed from the front illustrating the medium support unit of the first embodiment.

FIG. 6A is a schematic plan view illustrating the medium support unit 2 of the first embodiment, and FIG. 6B is a schematic cross-section as viewed from the front illustrating the medium support unit 2 of the first embodiment.

Figure 7A:
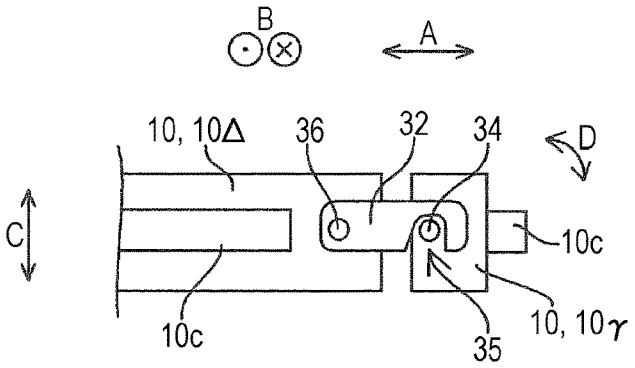
FIG. 7A is an enlarged schematic side view illustrating the medium support unit of the first embodiment.
Figure 7B:
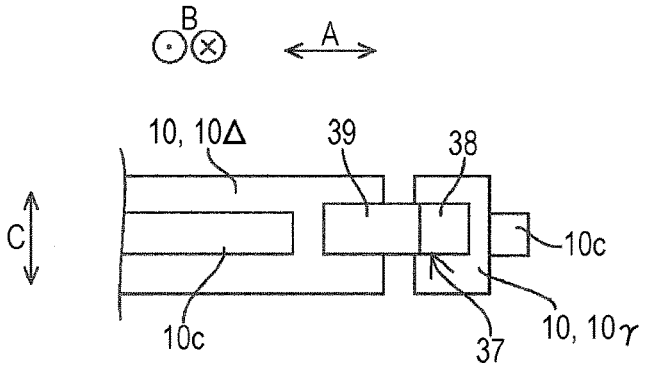
FIG. 7B is an enlarged schematic side view illustrating a medium support unit of a second embodiment.
Figure 7C:
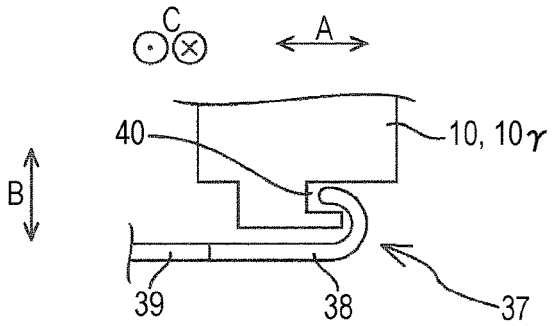
FIG. 7C is an enlarged schematic plan view illustrating the medium support unit of the second embodiment.

FIG. 7A is an enlarged schematic side view illustrating the medium support unit 2 of the first embodiment, FIG. 7B is an enlarged schematic side view illustrating the medium support unit 2 of a second embodiment, and FIG. 7C is an enlarged schematic plan view illustrating the medium support unit 2 of the second embodiment.

Figure 8A:
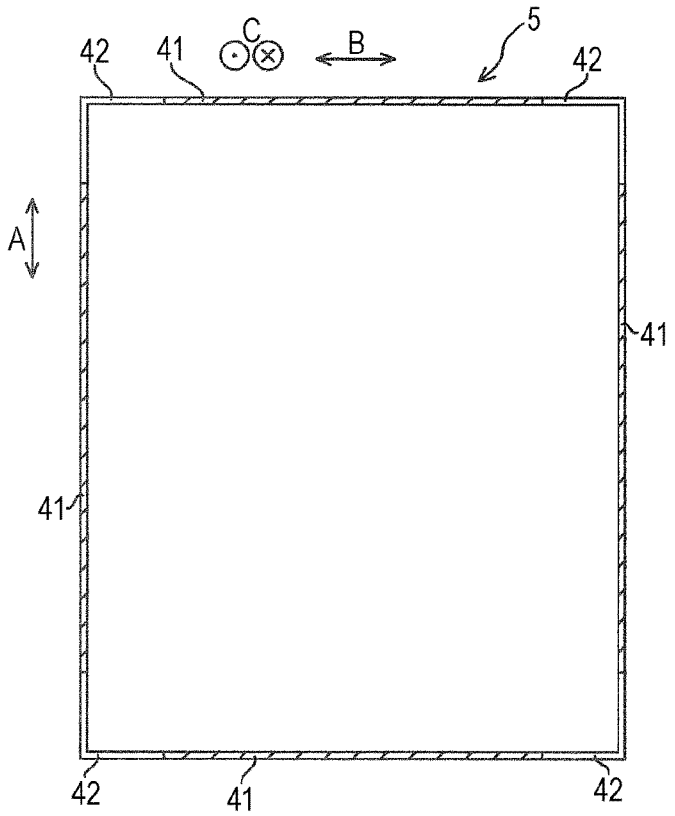
FIG. 8A is a schematic plan view illustrating a base of the printing apparatus according to the embodiment of the invention.
Figure 8C:
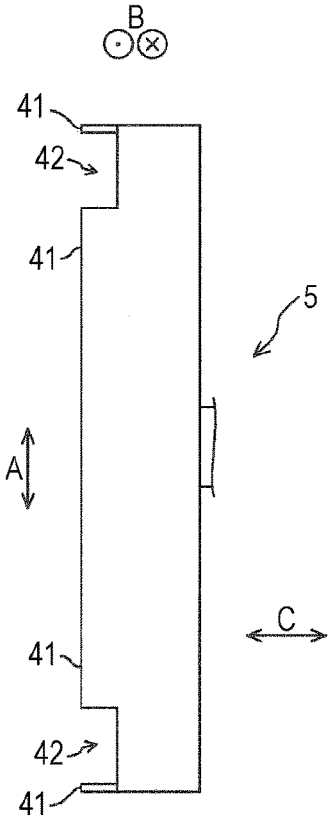
FIG. 8C is a schematic side view illustrating the base of the printing apparatus according to the embodiment of the invention.
Figure 8B:
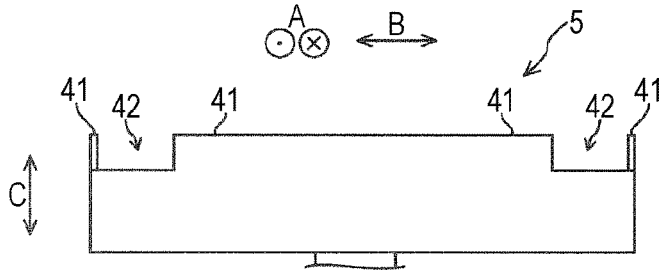
FIG. 8B is a schematic front view illustrating the base of the printing apparatus according to the embodiment of the invention.
Figure 8D:
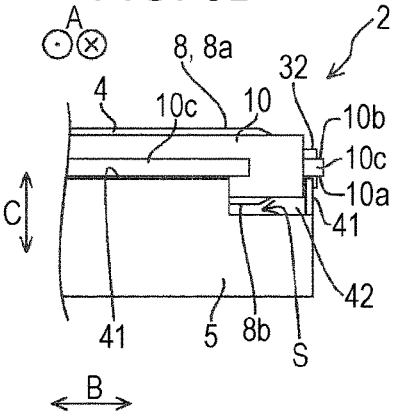
FIG. 8D is a schematic front view illustrating a state in which the medium support unit of the first embodiment is set on the base of the printing apparatus according to the embodiment of the invention.

FIG. 8A is a schematic plan view illustrating the base 5 of the printing apparatus 1 according to an embodiment of the invention, FIG. 8B is a schematic front view illustrating the base 5 of the printing apparatus 1 according to the embodiment of the invention, FIG. 8C is a schematic side view illustrating the base 5 of the printing apparatus 1 according to the embodiment of the invention, and FIG. 8D is a schematic front view illustrating a state in which the medium support unit 2 of the first embodiment is set on the base 5 of the printing apparatus 1 according to the embodiment of the invention (specifically, a state in which first placement portions 10*a*, described below, are placed on the base 5).

As illustrated in FIG. 5A to FIG. 5C, the tray 4 of the medium support unit 2 of the first embodiment has two faces that can support a medium. The tray 4 has a first support face 8*a* and a second support face 8*b* capable of supporting the medium. Note that the first support face 8*a* and the second support face 8*b* of the tray 4 of the present embodiment may support different medium. Moreover, the tray 4 may, for example, be inserted into a sack-shaped medium such as a T-shirt such that a front face (for example, the chest side of a T-shirt) of the medium is supported by the first support face 8*a* and a rear face (for example, the back side of a T-shirt) of the medium is supported by the second support face 8*b*.

As illustrated in FIG. 6A and FIG. 6B, the medium support unit 2 of the present embodiment includes the tray 4 and the frame section 10. The frame section 10 is configured so as to retain the tray 4 that supports a medium and so as to be mountable on the base 5 illustrated in FIG. 8A to FIG. 8D. Configuration of the frame section 10 is such that by switching the side mounted on the base 5 between the first support face 8*a* and the second support face 8*b* (that is, by flipping the medium support unit 2 upside down), both the first support face 8*a* side and the second support face 8*b* side can be printed on.

Note that each of the figures from FIG. 5A to FIG. 8D illustrates a state in which the first support face 8*a* is to be used as a printing face 8.

Namely, the medium support unit 2 of the present embodiment is a medium support unit 2 that supports a medium printed on by the printing apparatus 1. The medium support unit 2 includes a tray 4 that has a first support face 8*a* and a second support face 8*b* both capable of supporting the medium, and a frame section 10 that retains (holds) the tray 4. As illustrated in FIG. 6B (a cross-section taken along the dashed line VIB in FIG. 6A) and FIG. 8D, the frame section 10 includes first placement portions 10*a* that are placed on the base 5 (specifically, ribs 41) of the printing apparatus 1 when the first support face 8*a* side is set as the printing face 8 to be printed on, and second placement portions 10*b* that are placed on the base 5 (specifically, ribs 41) when the second support face 8*b* side is set as the printing face 8.

Due to such configuration, a medium-supporting face is able to be easily changed and printed on by printing with the first support face 8*a* as the printing face 8 and then printing with the second support face 8*b* as the printing face 8. By placing the first placement portions 10*a* on the base 5 when the first support face 8*a* side is to be printed on, and placing the second placement portions 10*b* on the base 5 when the second support face 8*b* side is to be printed on, the tray 4 can be stably supported on the base 5 and also the medium can be stably supported on the tray 4. The medium support unit 2 of the present embodiment is thereby configured such that a medium-supporting face can be easily switched and printed on with a medium stably supported on the tray 4.

Said differently, a medium-supporting face can be easily switched and printed on with a medium stably supported on the tray 4, because the printing apparatus 1 of the present embodiment includes the thus-configured medium support unit 2, base 5, and print head 7 that prints on a medium supported by the tray 4 of the medium support unit 2 placed on the base 5.

As illustrated in FIG. 5A, the tray 4 is configured with a shape having four rounded corners 15, and thus the medium is less likely to wrinkle when the medium is set on the tray 4. As illustrated in FIG. 5B, FIG. 5C, and FIG. 6B, the tray 4 is configured by two base members 13 and a connection portion 18 that connects the base members 13 together. One base member 13 is disposed on the first support face 8*a* side of the tray 4 and includes the first support face 8*a*. The other base member 13 is disposed on the second support face 8*b* side of the tray 4 and includes the second support face 8*b*. A housing portion 30 is provided between the base member 13 on the first support face 8*a* side and the base member 13 on the second support face 8*b* side. The housing portion 30 is able to house excess portions (portions protruding from the first support face 8*a* and the second support face 8*b*) of a medium set on the tray 4. A silicon layer 14 is formed on the first support face 8*a* and the second support face 8*b* so that a medium set on the tray 4 does not slip. The silicon layer 14 elastically deforms such that even if pressure is applied to a medium, the occurrence of pressure marks on the medium can be reduced. In addition, configuring the silicon layer 14 as a heat-resistant silicon layer enables the suppression of plastic deformation and the like of the silicon layer 14 due to heat when a printed image formed on a medium is cured (fixed) by a heating apparatus after printing is completed.

In the medium support unit 2 of the present embodiment, the frame section 10 is configured by two configuration members (a frame portion 10γ and a frame portion 10Δ), each configured in an L-shape as illustrated in FIG. 6A. As illustrated in FIG. 6B, the frame section 10 is inserted between the first support face 8*a* and the second support face 8*b* such that the frame section 10 is able to retain the tray 4. By adopting such a configuration, the frame section 10 is easily configured not to protrude from the printing face 8 (the upper side) (see FIG. 6B). This configuration makes it easy to suppress protrusion of the frame section 10 from the printing face 8 such that printing is obstructed (by, for example, contact with the print head 7), or curing of the printed image by a heating apparatus is obstructed.

As illustrated in FIG. 5B and FIG. 5C, in the medium support unit 2 of the present embodiment, an inclined portion 17 is provided to an outer peripheral portion 16 of the first support face 8*a* and of the second support face 8*b* such that the outer peripheral portions 16 each have a tapered shape. In other words, the inclined portion 17 is inclined such that in a state in which the frame section 10 is placed on the base 5 (see FIG. 6B), a medium is supported at the printing face 8 at a location closer to the base 5 (the lower side) the closer the medium is to the outer edge of the outer peripheral portion 16.

The inclined portion 17 is inclined in this way such that in a state in which the frame section 10 is placed on the base 5, positions where a medium is supported at the printing face 8 approach the base toward the outer edge of the outer peripheral portion 16. Such an inclined portion 17 is preferably provided at the outer peripheral portion 16 of at least one of the first support face 8*a* or the second support face 8*b*. The outer peripheral portion 16 of the first support face 8*a* and the second support face 8*b* are liable to leave a mark on portions of a medium they support. However, adopting the inclined portion 17 enables marking of the medium to be suppressed.

As illustrated in FIG. 6A, the frame section 10 of the medium support unit 2 of the present embodiment is provided with marks 33*a* and 33*b* to indicate the orientation of the medium support unit 2 when placing the medium support unit 2 on the base 5. Accordingly, when placing the frame section 10 on the base 5, placement of the frame section 10 on the base 5 in an incorrect orientation can be suppressed.

Note that in the present embodiment, the mark 33*a* is formed on one movement direction A side (the frame portion 10γ) of the medium support unit 2, and the mark 33*b* is formed on the other side (the frame portion 10Δ) of the medium support unit 2. The mark 33*a* and the mark 33*b* have different colors. Adopting such marks makes it easier to place the frame section 10 on the base 5 in a correct orientation, particularly when placing the frame section 10 on the base 5. In addition, in cases in which a medium support unit 2 on which a medium has been set is set in another apparatus (such as a heating apparatus), the setting orientation (printing direction) in the printing apparatus 1 can be matched with the setting orientation in the other apparatus. Herein, although the marks 33*a* and 33*b* of the present embodiment are marks that differ in color, the marks 33*a* and 33*b* may be marks that differ in shape, size, and so on.

As illustrated in FIG. 6B, the frame section 10 of the present embodiment includes an insertion portion 10*d* and a protrusion 10*c*. The insertion portion 10*d* is inserted into the housing portion 30. The protrusion 10*c* serves as a placement portion when the frame section 10 formed with the first placement portions 10*a* and the second placement portions 10*b* is placed on the base 5. A silicon layer 31 is formed on the insertion portion 10*d* of the frame section 10 so that a medium set on the tray 4 does not slip. The silicon layer 14 elastically deforms such that even if pressure is applied to a medium, the occurrence of pressure marks on the medium can be reduced. In addition, configuring the silicon layer 31 as a heat-resistant silicon layer enables the suppression of plastic deformation and the like of the silicon layer 31 due to heat when a printed image formed on a medium is cured by a heating apparatus after printing has completed. The silicon layer 31 also insures that the insertion portion 10*d* securely fits in the housing portion 30.

As illustrated in FIG. 6A and FIG. 7A (an enlargement as viewed along direction VIIA in FIG. 6A), the frame section 10 of the present embodiment is configured by two configuration members, these being the frame portion 10γ and the frame portion 10Δ. The frame portion 10γ and frame portion 10Δ can be connected together by connection portions 32 so as to firmly fix the tray 4 within the frame section 10. As illustrated in FIG. 7A, each of the connection portions 32 is configured so as to be rotatable along a rotation direction D about a rotation shaft 36. A cutout 35 is formed in each connection portion 32 at the opposite side to the rotation shaft 36. The cutout 35 is latched onto a pin 34 formed in the other frame portion of the frame section 10, so that the two frame portions of the frame section 10 can be connected together. Note that although the connection portion 32 illustrated in FIG. 7A is provided to the frame portion 10Δ and the respective pin 34 is provided to the frame portion 10γ, in addition to the connection portion 32 illustrated in FIG. 7A, another connection portion 32 is provided to the frame portion 10γ and a respective pin 34 is provided to the frame portion 10Δ.

Note that there is no limitation to the configuration by which both sides of the frame section 10 are connected together (the configuration of the connection portion 32). For example, according to the medium support unit 2 of a second embodiment illustrated in FIG. 7B and FIG. 7C includes a connection unit 37 configured by an elastic portion 39 which are formed from heat-resistant silicone rubber, and the hook-shaped portion 38. The two sides of the frame section 10 are connected together by hitching the hook-shaped portion 38 into a hitch portion 40 formed in the other frame portion of the frame section 10.

As illustrated in FIG. 8A to FIG. 8D, ribs 41 on which the first placement portions 10*a* and the second placement portions 10*b* are placed are formed along the perimeter of the base 5 of the printing apparatus 1 of the present embodiment. Note that non-formed portions 42 where the ribs 41 are not formed are provided at the four corners of the base 5. The non-formed portions 42 correspond to the positions of the connection portions 32. The non-formed portions 42 are provided so that the ribs 41 do not interfere with the connection portions 32.

As illustrated in FIG. 8D, the printing apparatus 1 of the present embodiment is configured such that an open space S is provided between the tray 4 and the base 5 in a state in which the frame section 10 is placed on the base 5. With this configuration, when the second support face 8*b* is set as the printing face and printed on after the first support face 8*a* has been set as the printing face and printed on, reduction in image quality due to a previously printed portion (printed image) printed on the first support face 8*a* side making contact with the base 5 when the second support face 8*b* side is printed on can be suppressed.

Additional explanation follows regarding the medium support unit 2, which is a relevant portion of the printing apparatus 1 of the present embodiment.

Figure 9A:
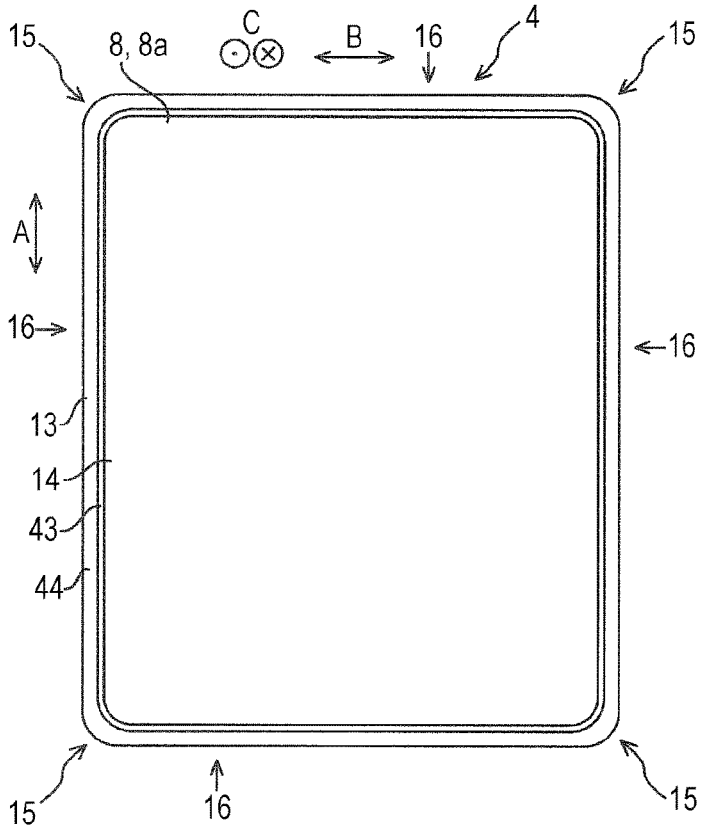
FIG. 9A is a schematic plan view illustrating a tray of a medium support unit of a third embodiment.
Figure 9C:
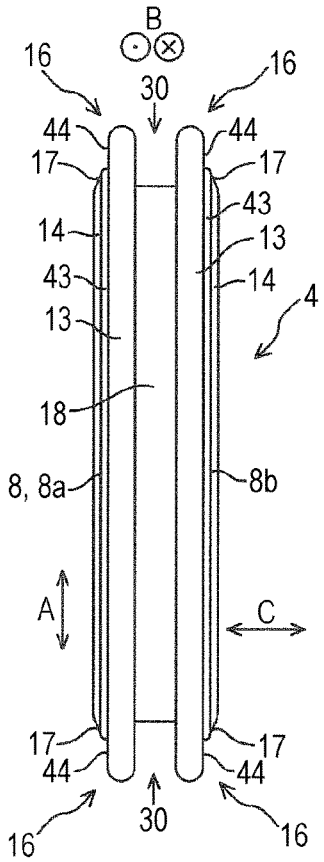
FIG. 9C is a schematic side view illustrating the tray of the medium support unit of the third embodiment.
Figure 9B:
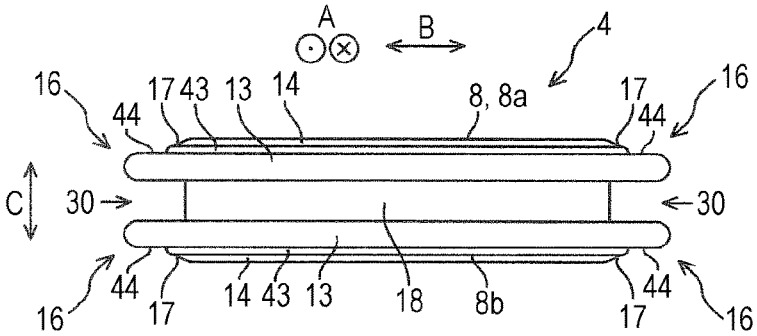
FIG. 9B is a schematic front view illustrating the tray of the medium support unit of the third embodiment.

FIG. 9A is a schematic plan view illustrating the tray 4 of the medium support unit 2 of a third embodiment, FIG. 9B is a schematic front view illustrating the tray 4 of the medium support unit 2 of the third embodiment, and FIG. 9C is a schematic side view illustrating the tray 4 of the medium support unit 2 of the third embodiment.

Figure 10A:
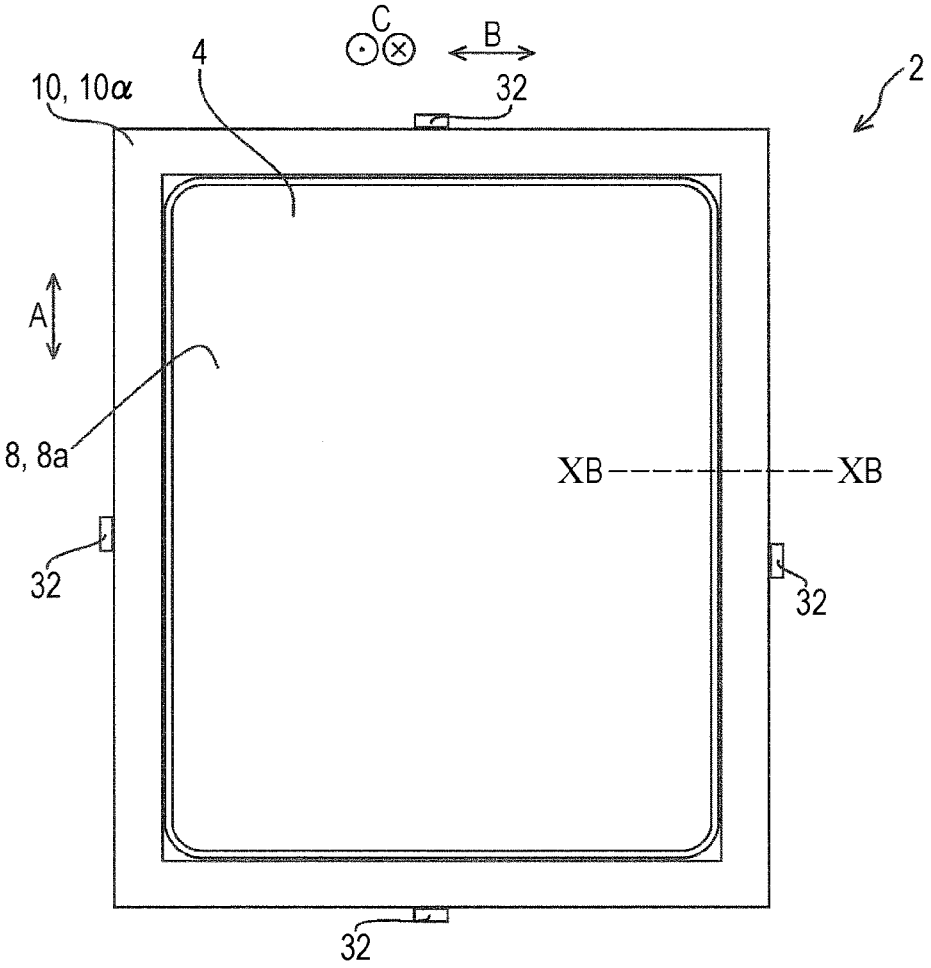
FIG. 10A is a schematic plan view illustrating the medium support unit of the third embodiment.
Figure 10B:
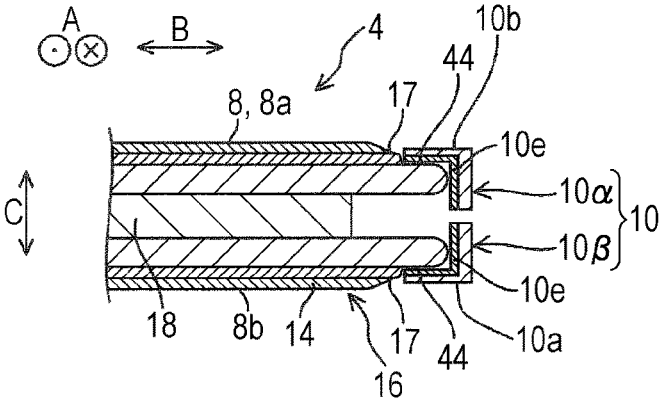
FIG. 10B is a schematic cross-section as viewed from the front illustrating the medium support unit of the third embodiment.

FIG. 10A is a schematic plan view illustrating the medium support unit 2 of the third embodiment, and FIG. 10B is a schematic cross-section as viewed from the front illustrating the medium support unit 2 of the third embodiment.

Figure 11A:
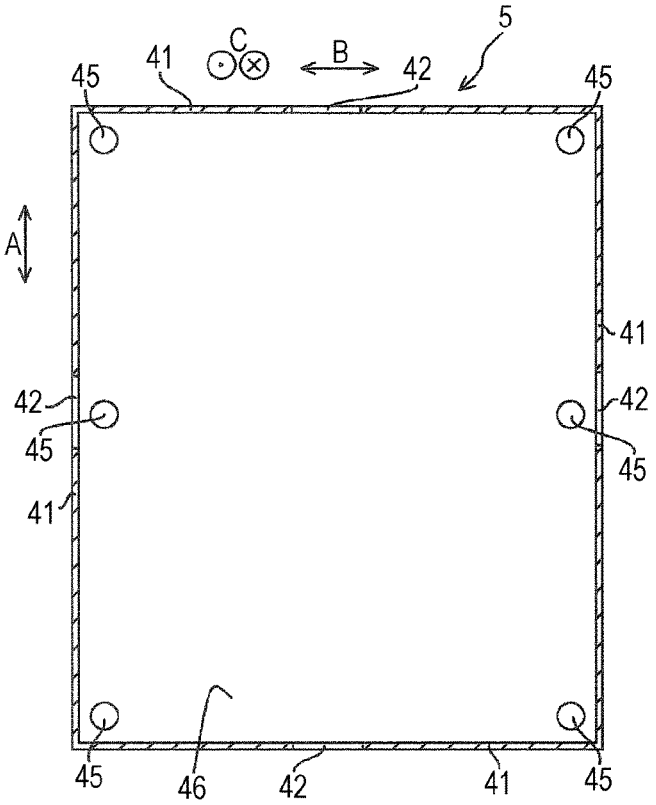
FIG. 11A is a schematic plan view illustrating a base of a printing apparatus according to another embodiment of the invention.
Figure 11C:
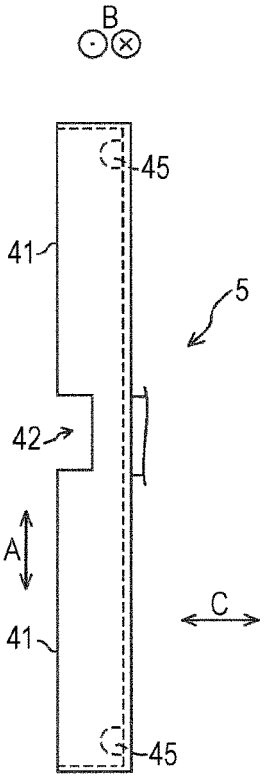
FIG. 11C is a schematic side view illustrating the base of the printing apparatus according to the other embodiment of the invention.
Figure 11B:
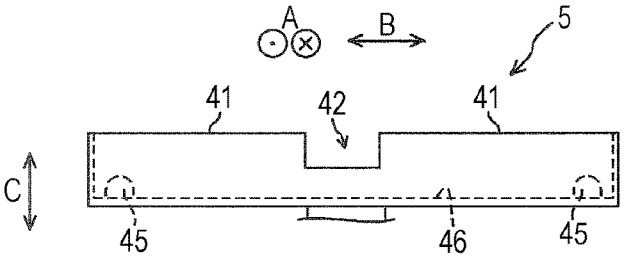
FIG. 11B is a schematic front view illustrating a base of the printing apparatus according to the other embodiment of the invention.
Figure 11D:
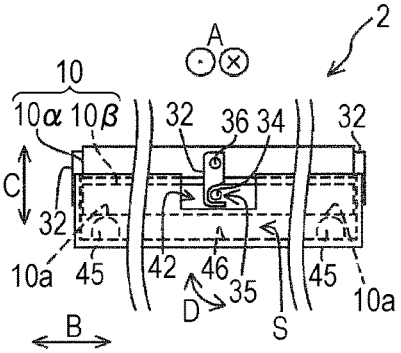
FIG. 11D is a schematic front view illustrating a state in which the medium support unit of the third embodiment is set on the base of the printing apparatus according to the other embodiment of the invention.

FIG. 11A is a schematic plan view depicting the base 5 of the printing apparatus 1 according to another embodiment of the invention, FIG. 11B is a schematic front view illustrating the base 5 of the printing apparatus 1 according to this other embodiment of the invention, FIG. 11C is a schematic side view illustrating the base 5 of the printing apparatus 1 according to this other embodiment of the invention, and FIG. 11D is a schematic front view illustrating a state in which the medium support unit 2 of the third embodiment is set on the base 5 of the printing apparatus 1 according to this other embodiment of the invention.

Figure 12A:
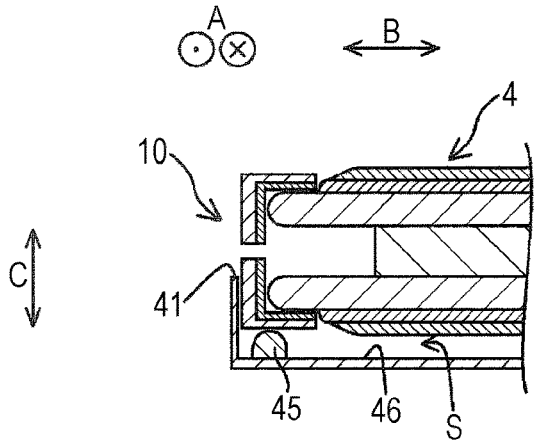
FIG. 12A is a schematic cross-section as viewed from the front illustrating a state in which the medium support unit of the third embodiment is set on the base of the same printing apparatus as that of FIG. 11A to FIG. 11D.
Figure 12B:
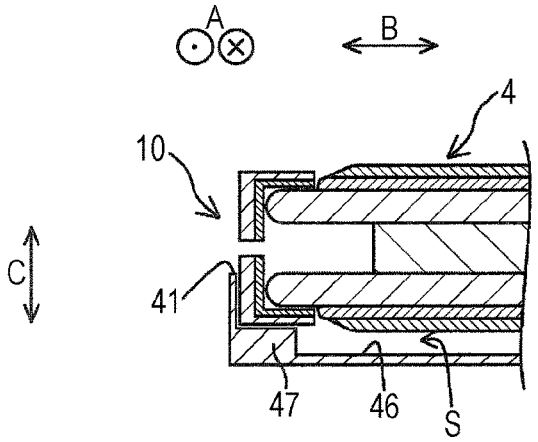
FIG. 12B is a schematic cross-section as viewed from the front illustrating a state in which the medium support unit of the third embodiment is set on a base of a printing apparatus according to yet another embodiment of the invention.

FIG. 12A is a schematic cross-section as viewed from the front illustrating a state in which the medium support unit 2 of the third embodiment is set on the base 5 of the same printing apparatus as that of FIG. 11A to FIG. 11D, and FIG. 12B is a schematic cross-section as viewed from the front illustrating a state in which the medium support unit 2 of the third embodiment is set on the base 5 of the printing apparatus 1 according to yet another embodiment of the invention.

Figure 13:
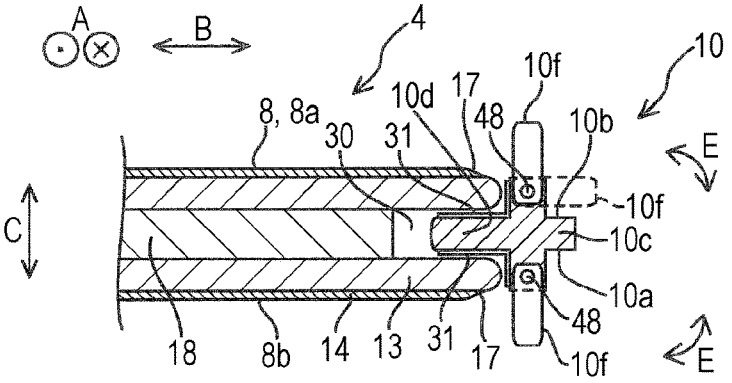
FIG. 13 is a schematic cross-section as viewed from the front illustrating a medium support unit of a fourth embodiment.

FIG. 13 is a schematic cross-section as viewed from the front illustrating the medium support unit 2 of a fourth embodiment.

As illustrated in FIG. 9A to FIG. 9C, the tray 4 of the medium support unit 2 of the third embodiment is configured similarly to the tray 4 of the first embodiment except for that a planar portion 44 is provided to the outer peripheral portion 16 of each of the base members 13, and an intermediate layer 43 is formed between the base members 13 and the respective silicon layer 14.

As illustrated in FIG. 10A and FIG. 10B (a cross-section taken along dashed line XB in FIG. 10A), the frame section 10 of the medium support unit 2 of the present embodiment has a configuration in which two rectangle-shaped frames (a frame portion 10α and a frame portion 10β) are able to be respectively pressed on the planar portions 44 from the top and bottom (the attachment/detachment direction C) such that the tray 4 is pinched there between.

In other words, the frame section 10 of the present embodiment is configured to retain the tray 4 by pinching the tray 4 from the first support face 8*a*-side and the second support face 8*b*-side. Such a configuration enables the tray 4 to be suitably retained by the frame section 10.

Herein, when the frame portion 10α and the frame portion 10β pinch the tray 4, the heights of the frame portion 10α and the frame portion 10β are sufficiently shorter in height than the support faces 8*a* and 8*b* (so as not to project from the support faces 8*a* and 8*b*). Specifically, configuration is such that the first placement portions 10*a* of the frame portion 10α are positioned at a lesser height than the second support face 8*b*, and the second placement portions 10*b* of the frame portion 10β are positioned at a lesser height than the first support face 8*a*. This enables the frame portion 10α and the frame portion 10β to be suppressed from obstructing printing by the printing apparatus or obstructing heating by the heating apparatus.

A silicon layer 10*e* is formed at positions on the side of the frame section 10 that contacts the base members 13 so that medium set on the tray 4 does not slip. The silicon layer 10*e* elastically deforms such that even if pressure is applied to a medium, the occurrence of pressure marks on the medium can be reduced. In addition, configuring the silicon layer 10*e* as a heat-resistant silicon layer enables the suppression of plastic deformation and the like of the silicon layer 10*e* due to heat when a printed image formed on a medium is cured by a heating apparatus after printing has completed.

As illustrated in FIG. 10A and FIG. 11D, the frame section 10 is provided with connection portions 32 similar to the connection portions 32 of the medium support unit 2 of the first embodiment. Thus, the frame portion 10α and the frame portion 10β of the medium support unit 2 of the present embodiment are able to be connected by the connection portion 32, enabling the tray 4 to be firmly fixed therein. Note that although a total of four connection portions 32 are provided in the present embodiment, with one connection portion 32 being provided for each side of the rectangle-shaped frame section 10, there is no limitation to such configuration. For example, a total of eight connection portions 32 may be provided, with two connection portions 32 being provided for each side of the rectangle-shaped frame section 10.

Note that, as illustrated in FIG. 11A to FIG. 11D, ribs 41 and non-formed portions 42 are provided to the base 5 of the printing apparatus 1 of the present embodiment similarly to the base 5 illustrated in FIG. 8A to FIG. 8D. However, since the positions of the connection portion 32 differ in the medium support unit 2 of the first embodiment and the medium support unit 2 of the present embodiment, the positions of the non-formed portions 42 also differ from positions of the connection portion 32 in the medium support unit 2 of the first embodiment.

As illustrated in FIG. 11A to FIG. 11D and FIG. 12A, projections 45 are provided to a bottom portion 46 of the base 5 of the printing apparatus 1 of the present embodiment, at positions corresponding to the frame section 10 (more specifically, at positions corresponding to the first placement portions 10*a* and the second placement portions 10*b*). By making configuration such that the first placement portion 10*a* or the second placement portions 10*b* are placed on the projections 45, an open space S is provided between the tray 4 and the base 5. Thus, when the second support face 8*b* is set as the printing face and printed on after the first support face 8*a* has been set as the printing face and printed on, a reduction in image quality due to a previously printed-on portion making contact with the base 5 is suppressed (see FIG. 11D and FIG. 12A).

However, there is no limitation to such configuration. For example, as in the printing apparatus 1 illustrated in FIG. 12B, configuration may be such that in place of the projections 45, step portions 47 are formed at positions corresponding to the first placement portions 10*a* and the second placement portions 10*b*.

In addition, the frame section 10 may be configured like the frame section 10 of the medium support unit 2 of a fourth embodiment illustrated in FIG. 13. The frame section 10 of the medium support unit 2 of the fourth embodiment has a configuration in which the frame section 10 of the medium support unit 2 of the first embodiment is provided with leg portions 10*f* that rotate along a rotation direction E about a respective rotation shaft 48. By adopting such a configuration, the leg portions 10*f* can be made to stand such that the medium support unit 2 is able be placed on a placement face without a medium making contact with the placement face when a medium support unit 2 on which the medium has been set is removed from the printing apparatus 1. In addition, by adopting such a configuration, the leg portions 10*f* can be made to lay down when printing is to be performed such that interference between the print head 7 and the leg portions 10*f* can be suppressed.

Explanation follows regarding an embodiment of a heating apparatus capable of heating a medium that has been printed on using the medium support unit 2. The heating apparatus is explained using the example of a heat press in which a movable heater contacts a medium so as to apply pressure and heat. However, the heating apparatus may be an oven that applies heat without the heater contacting the medium.

Figure 14A:
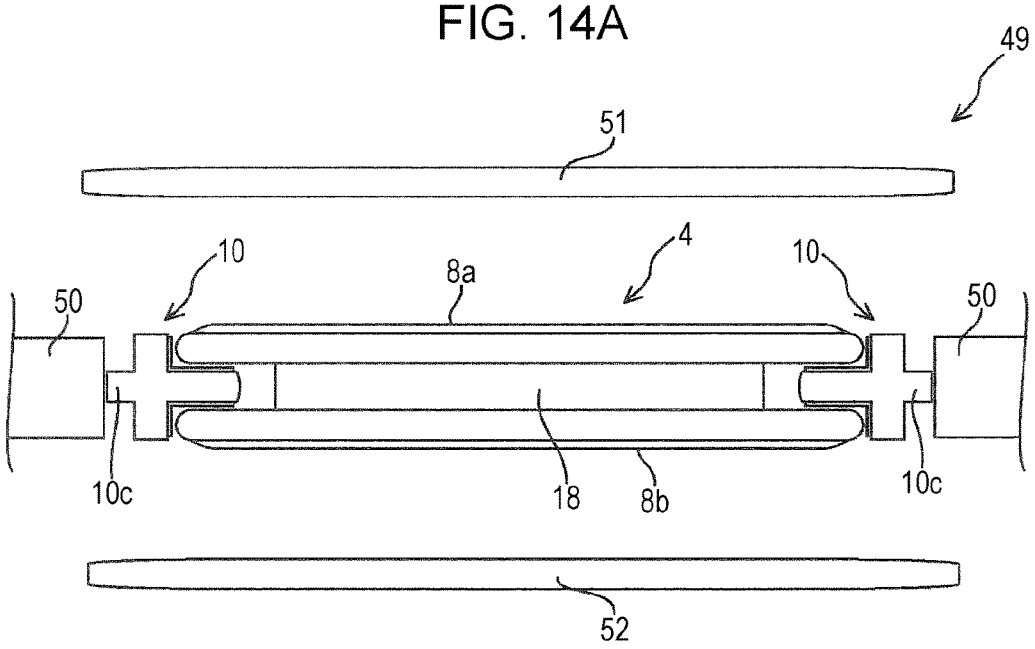
FIG. 14A is a schematic diagram illustrating a heating apparatus according to an embodiment of the invention.
Figure 14B:
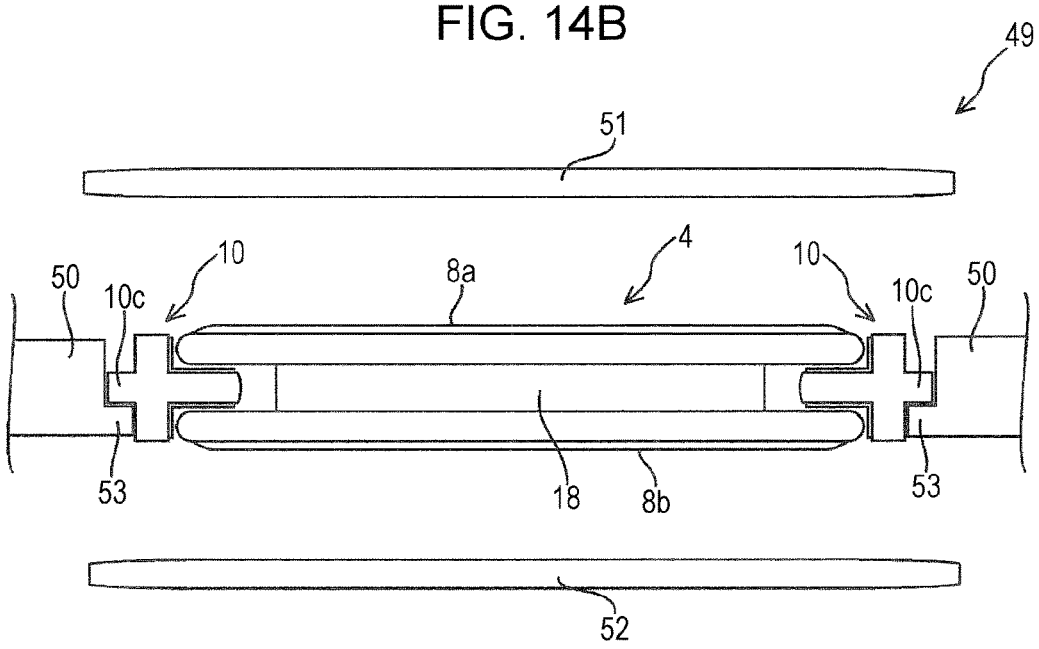
FIG. 14B is a schematic diagram illustrating a heating apparatus according to another embodiment of the invention.

FIG. 14A and FIG. 14B illustrate an embodiment of a heating apparatus 49 capable of heating a medium that has been printed on using the medium support unit 2. FIG. 14A is a schematic diagram illustrating the heating apparatus 49 according to an embodiment of the invention, and FIG. 14B is a schematic diagram illustrating the heating apparatus 49 according to another embodiment of the invention.

The heating apparatus 49 illustrated in FIG. 14A includes mounting portions 50 and heaters 51 and 52. The mounting portions 50 are able to pinch a medium support unit 2 on which a medium has been set and printed on as-is between the installation portions 50 such that the medium support unit 2 is affixed thereto. The heaters 51 and 52 are capable of applying heat from both the first support face 8*a* side and the second support face 8*b* side. The heater 51 and the heater 52 are able to have their respective temperatures set independently of the other, and are configured to move so as contact the medium support unit 2 at the same time.

The heating apparatus 49 illustrated in FIG. 14B includes mounting portions 50 and the heaters 51 and 52. Each mounting portion 50 has a placement portion 53 onto which the protrusions 10*c* of a medium support unit 2, on which a medium has been set and printed on, can be placed. The heaters 51 and 52 are capable of applying heat from both the first support face 8*a* side and the second support face 8*b* side. The mounting portions 50 are configured so that, when the medium support unit 2 is mounted on the mounting portions 50, the upper and lower sides of mounting portions 50 will be lower than the first support face 8*a* and the second support face 8*b* (i.e., will not project beyond the first support face 8*a* and the second support face 8*b*). This enables the mounting portion 50 to be suppressed from obstructing heating by the heaters 51 and 52.

Note that in FIG. 14A and FIG. 14B, although the first support face 8*a* is set opposing the heater 51 and the second support face 8*b* is set opposing the heater 52, the first support face 8*a* and the second support face 8*b* may be set having the opposite relationship.

Thus, the heating apparatuses 49 illustrated in FIG. 14A and FIG. 14B both include mounting portions 50 mountable with the medium support unit 2, and the heaters 51 and 52 serving as a heating section that is capable of heating both the first support face 8*a* and the second support face 8*b* of the tray 4 of a medium support unit 2 mounted to the mounting portions 50. Employing such a heating apparatus 49 enables a printed article that was printing on while stably supported on the tray 4, and wherein the medium-supporting face was easily changed, to be easily heated on both faces on the first support face 8*a* side and the second support face 8*b* side at once, without removing the printed article from the medium support unit 2, so as to fix printed images on a printed article.

Detailed explanation using a flowchart follows regarding a printing method that can be carried out using the above-described printing apparatus 1 (a printing apparatus 1 of the present embodiments) illustrated in FIG. 1 to FIG. 3.

Figure 15:
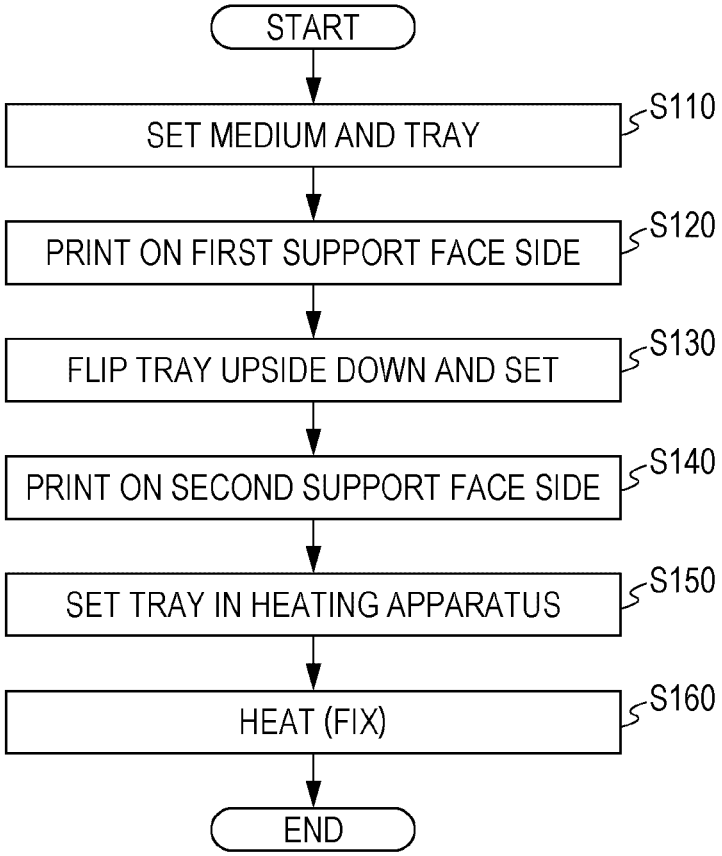
FIG. 15 is a flowchart for a printing method that can be carried out using a printing apparatus according to an embodiment of the invention.

FIG. 15 is a flowchart of a printing method that can be carried out using the printing apparatus 1 of the present embodiments.

First, at step S110, a user sets a medium on the tray 4, and then sets the medium support unit 2 on which the medium has been set in the printing apparatus 1 (the first placement portions 10*a* are placed on the base 5).

Next, at step S120, the first support face 8*a* side is printed on.

Next, at step S130, the tray 4 (the medium support unit 2) is flipped upside down and the medium support unit 2 is set in the printing apparatus 1 (the second placement portions 10*b* are placed on the base 5).

Note that when a related printing apparatus is employed rather than the printing apparatus 1 of the present embodiments, a process of removing the medium from the medium support unit 2, a process of setting the medium in a heating apparatus, and a process heating the medium set in the heating apparatus, and so on, may be necessary between step S120 and step S130. Namely, carrying out the printing method of the present embodiments enables these processes to be omitted.

Next, at step S140, the second support face 8*b* side is printed on.

Next, at step S150, the entire tray 4 (medium support unit 2) is set in the heating apparatus 49.

Then, at step S160, the medium set in the heating apparatus 49 is heated, and the printing method of the present embodiments ends.

Note that when a related printing apparatus is employed rather than the printing apparatus 1 of the present embodiments, a process of removing the medium from the medium support unit 2, and so on, may be necessary between step S140 and step S150. Namely, carrying out the printing method of the present embodiments enables this process to be omitted.

As described above, the printing method of the present embodiments is a printing method employing the medium support unit 2 including the tray 4 and the frame section 10. The tray 4 has the first support face 8*a* and the second support face 8*b* capable of supporting a medium to be printed on by the printing apparatus 1. The frame section 10 is capable of retaining the tray 4, and includes the first placement portion 10*a* that is placed on the base 5 of the printing apparatus 1 when the first support face 8*a* side is set as the printing face 8 to be printed on, and includes the second placement portion 10*b* that is placed on the base 5 when the second support face 8*b* side is set as the printing face 8. In the printing method, the first placement portion 10*a* is placed on the base 5 and the first support face 8*a* side is printed on (step S110 and step S120), and then the second placement portion 10*b* is placed on the base 5 and the second support face 8*b* side is printed on (step S130 and step S140).

By thus placing the first placement portion 10*a* on the base 5 and printing on the first support face 8*a* side as the printing face 8 and then placing the second placement portion 10*b* on the base 5 and printing on the second support face 8*b* side as the printing face 8, a medium-supporting face is able to be easily changed and printed on while the medium is stably supported on the tray 4.

Note that the invention is not limited to the above embodiments, and various modifications are possible within the scope of the invention encompassed by the patent claims. Such modifications also fall within the scope of the invention.

Moreover, each medium support unit 2 in the first embodiment to the fourth embodiment described above has a similar shape when viewed from the first support face 8*a* side and when viewed from the second support face 8*b* side. Accordingly, the first support face 8*a* may be read to be the second support face 8*b*, and the second support face 8*b* may be read to be the first support face 8*a*.

Moreover, although the tray 4 of the medium support unit 2 of the above embodiments is configured such that the tray 4 has two faces with which it is able to support a medium, configuration may be such that the tray 4 has three or more faces with which it is able to support a medium. For example, when a third support face and a fourth support face are provided in addition to the first support face 8*a* and the second support face 8*b*, it is possible to print on four faces of a T-shirt (the chest, back, left side, and right side).

This application claims priority under 35 U.S.C. § 119 to Japanese Patent Application No. 2016-171037, filed Sep. 1, 2016. The entire disclosure of Japanese Patent Application No. 2016-171037 is hereby incorporated herein by reference.

What is claimed is:

1. A medium support unit that supports a medium to be printed on by a printing apparatus, the medium support unit comprising:

a support section having a first support face and a second support face that are capable of supporting the medium; and a frame section that retains the support section, the frame section including a first placement portion that is placed on a base of the printing apparatus when the first support face is set as a printing face on which the medium is printed, and a second placement portion that is placed on the base when the second support face is set as the printing face, wherein the frame section is inserted between the first support face and the second support face to retain the support section.

2. The medium support unit according to claim 1, wherein an inclined portion is provided at an outer peripheral portion of at least one of the first support face or the second support face, and the inclined portion is inclined such that in a state in which the frame section is placed on the base, positions where the medium is supported at the printing face approach the base toward the outer edge of the outer peripheral portion.

3. A printing apparatus comprising:

the medium support unit according to claim 2;

the base; and a printing section that prints on the medium being supported by the support section of the medium support unit placed on the base.

4. A heating apparatus comprising:

an mounting portion mountable with the medium support unit according to claim 2; and a heating section capable of heating both the first support face and the second support face of the support section of the medium support unit mounted to the mounting portion.

5. The medium support unit according to claim 1, wherein the frame section is provided with a mark to indicate the orientation of the medium support unit when the medium support unit is placed on the base.

6. A printing apparatus comprising:

the medium support unit according to claim 5;

the base; and a printing section that prints on the medium being supported by the support section of the medium support unit placed on the base.

7. A heating apparatus comprising:

an mounting portion mountable with the medium support unit according to claim 5; and a heating section capable of heating both the first support face and the second support face of the support section of the medium support unit mounted to the mounting portion.

8. A printing apparatus comprising:

the medium support unit according to claim 1;

the base; and a printing section that prints on the medium being supported by the support section of the medium support unit placed on the base.

9. The printing apparatus according to claim 8, wherein in a state in which the frame section is placed on the base, an open space is provided between the support section and the base.

10. A heating apparatus comprising:

a mounting portion mountable with the medium support unit according to claim 1; and a heating section capable of heating both the first support face and the second support face of the support section of the medium support unit mounted to the mounting portion.

11. A medium support unit that supports a medium to be printed on by a printing apparatus, the medium support unit comprising:

a support section having a first support face and a second support face that are capable of supporting the medium; and a frame section that retains the support section, the frame section including a first placement portion that is placed on a base of the printing apparatus when the first support face is set as a printing face on which the medium is printed, and a second placement portion that is placed on the base when the second support face is set as the printing face, wherein the frame section pinches the support section from the first support face-side and the second support face-side to retain the support section.

12. A printing apparatus comprising:

the medium support unit according to claim 11;

the base; and a printing section that prints on the medium being supported by the support section of the medium support unit placed on the base.

13. A heating apparatus comprising:

an mounting portion mountable with the medium support unit according to claim 11; and a heating section capable of heating both the first support face and the second support face of the support section of the medium support unit mounted to the mounting portion.

14. A printing method employing a medium support unit including a support section having a first support face and a second support face that are capable of supporting a medium to be printed on by a printing apparatus, and a frame section that is capable of retaining the support section and the medium supported by the support section, the frame section including a first placement portion that is placed on a base of the printing apparatus when the first support face is set as a printing face on which the medium is printed, and a second placement portion that is placed on the base when the second support face is set as the printing face, wherein the frame section is inserted between the first support face and the second support face to retain the support section, the printing method comprising:

placing the first placement portion on the base and printing on the medium on the first support face; and placing the second placement portion on the base and printing on the medium on the second support face.

* * * * *